US011219292B2

(12) United States Patent
Bianco

(10) Patent No.: US 11,219,292 B2
(45) Date of Patent: Jan. 11, 2022

(54) COSMETIC APPLICATOR WITH HEAT TRANSFER COMPONENT

(71) Applicant: Toly Management Ltd., Zejtun ZTN (MT)

(72) Inventor: Dorien Bianco, Zejtun (MT)

(73) Assignee: Toly Managment Ltd., Zejtun (MT)

( * ) Notice: Subject to any disclaimer, the term of this patent is extended or adjusted under 35 U.S.C. 154(b) by 0 days.

(21) Appl. No.: 16/899,858

(22) Filed: Jun. 12, 2020

(65) Prior Publication Data

US 2020/0397117 A1 Dec. 24, 2020

(51) Int. Cl.
*A46B 11/00* (2006.01)
*A45D 34/04* (2006.01)

(52) U.S. Cl.
CPC ..... *A45D 34/041* (2013.01); *A45D 2200/155* (2013.01); *A45D 2200/25* (2013.01)

(58) Field of Classification Search
CPC ..... A45D 34/041; A45D 2200/155
USPC ..... 401/1, 126
See application file for complete search history.

(56) References Cited

U.S. PATENT DOCUMENTS

| | | | | |
|---|---|---|---|---|
| 6,238,120 | B1 | 5/2001 | Mark | |
| 7,497,635 | B1 | 3/2009 | Bae | |
| 8,403,008 | B2 | 3/2013 | Bouix et al. | |
| 9,386,839 | B2 | 7/2016 | Bonnin et al. | |
| 9,427,064 | B2 * | 8/2016 | Kim | A45D 34/04 |
| 9,681,728 | B2 | 6/2017 | Jung | |
| 9,763,509 | B1 | 9/2017 | Dutton et al. | |
| 9,827,589 | B2 | 11/2017 | Daviot et al. | |
| 9,867,443 | B2 | 1/2018 | Kim et al. | |
| 10,098,437 | B2 * | 10/2018 | Kim | A45D 34/045 |
| 10,244,844 | B2 | 4/2019 | Lee | |
| 2009/0092435 | A1 | 4/2009 | Stevens | |
| 2015/0257510 | A1 * | 9/2015 | Kim | A45D 34/041 401/126 |
| 2020/0154858 | A1 | 5/2020 | Thorpe | |
| 2020/0288842 | A1 * | 9/2020 | Maurin | A45D 34/045 |
| 2020/0329846 | A1 * | 10/2020 | Bianco | A45D 40/267 |

FOREIGN PATENT DOCUMENTS

| | | |
|---|---|---|
| EP | 2437631 | 4/2012 |
| FR | 3036598 | 12/2016 |
| JP | 09132282 | 5/1997 |
| KR | 101909115 | 10/2018 |

* cited by examiner

*Primary Examiner* — Jennifer C Chiang
(74) *Attorney, Agent, or Firm* — Wissing Miller LLP

(57) ABSTRACT

A cosmetic package for applying a composition including a cosmetic, care or pharmaceutical composition onto the keratinous substrate such as skin, lips, under eyes, eyelids, cheeks, or any other part of the body. The cosmetic package comprises a cosmetic container and a cosmetic dropper coupled to the cosmetic container. The cosmetic dropper further comprises a massage ball, a bulb portion, a cap and a pipe. The massage ball is made of a heat transfer material to transfer the heat or cold on contact with the keratinous substrate of a user.

14 Claims, 4 Drawing Sheets

COSMETIC APPLICATOR WITH HEAT TRANSFER COMPONENT

This application claims priority under 35 U.S.C. § 119 to Indian Provisional Patent Application No. 201911024902, filed on Jun. 23, 2019. The disclosure of each of this application is incorporated herein by reference.

BACKGROUND

Field

The present disclosure generally relates to a cosmetic dropper for applying a composition including a cosmetic, care or pharmaceutical composition, onto keratinous substrate such as skin, lips, under eyes, eyelids, cheeks, or any other part of the body. More particularly, the present disclosure relates to the cosmetic dropper with a massaging ball for serving the purpose of massaging which includes a metal component made of a heat transfer material to transfer the heat or cold on contact with the user's keratinous substrate.

Description of the Related Art

Devices exist for dispensing cosmetic, care or pharmaceutical compositions. Some cosmetic, care or pharmaceutical compositions may include therapeutic substances, such as topical anesthetics, analgesics, fragrances, menthol, or other substances that provide a soothing or stimulating sensation when applied onto the skin of a user. In addition to therapeutic substances, heat transfer treatments (e.g., application of heat and/or cold) are also known to provide a soothing or stimulating sensation when applied onto the skin of a user. These heat transfer treatments are done separately after applying the cosmetic composition onto the skin.

To avoid separate heat transfer treatments, various cosmetic packages are already known with the metal applicators. Metal applicators are used to transfer heat or cold sensation when a cosmetic composition is applied onto the skin. This is the case in particular for under eye care products for which manufacturers of cosmetic products consider that providing a cold effect on the skin when applying the composition allows to reduce wrinkles, remove under-eye bags, attenuate signs of fatigue, firm up or tighten the skin and/or make a person look momentarily younger.

Such benefits are linked to the effect of momentary constriction of blood vessels, resulting in decreased blood flow when the skin comes into contact with the composition providing a cold sensation upon application.

The known type of cosmetic packages with the metal applicators is having complicated assemblies to dispense cosmetic products. For example, pistons, valves or other parts are incorporated in the cosmetic package to control the flow of the low viscosity products. This type of complicated assembly is expensive hence not cost effective.

Thus, a simple structure for an applicator has been desired which is capable of not only transferring hot or cold at the time of application of the composition to the skin but also capable of dispense extra bulk and spreading the composition uniformly on the skin without the need of re-dipping the applicator for re-loading during usage. Further, a cosmetic dropper is desired which is comfortable and easier to use.

SUMMARY

Accordingly, there is provided a cosmetic dropper which comprises a massage ball at a distal end of a cosmetic dispensing opening of a dropper.

According to an aspect of the present disclosure, there is provided a cosmetic package for storing a cosmetic composition of a liquid or viscous nature. The cosmetic package includes a cosmetic dropper coupled to a cosmetic container. The cosmetic dropper further comprises an applicator member at its dispensing end.

According to another aspect of the present disclosure, the cosmetic dropper comprises a bulb portion, a pipe, the applicator member, and a cap. The bulb portion is pneumatically connected with the pipe for generating a pressure change for the suction of the cosmetic composition into the pipe. The pipe is connected to the applicator member at its distal end and to the bulb portion at the proximal end for suction of the cosmetic composition into the pipe. The cap is ring shaped and has internal threads which are threadedly engageable on the neck of the container. More particularly, the inner side of the cap has a screw threads which are corresponding to the threads of the neck.

According to a preferred embodiment, cosmetic container and the cosmetic dropper are removably engaged to each other by screwing together threads on the cap and the neck of the container. This is merely one example. Other methods such as a snap fit or an interference fit may be applied for securing the cosmetic container to the cosmetic dropper according to embodiments of the disclosure.

According to yet another aspect of the present disclosure, the cap includes a central hole through which a major portion of the bulb portion projects at a proximal end portion of the cosmetic dropper. Thus, the bulb portion is arranged majorly at the upper side of the cap. Further, the bulb portion includes an annular bottom sealing stopper which is received beneath a top surface of the cap, so that when the cap is tightened the stopper is clamped sealingly on a top rim of the container neck. A proximal end portion of the pipe extends through the through central hole of the cap and is connected to the bulb portion. Thus, the pipe is arranged majorly down side of the top surface of the cap.

According to yet another aspect of the present disclosure, the bulb portion is made of a soft material such as rubber for example, which is could be pressed easily to compress the bulb to pneumatically move substance into and out of the pipe. The bulb portion is formed to have a predetermined height on the upper side of the cap and can be formed of a soft material such as rubber as described above, so that the user can easily grasp the bulb section. If the user presses the bulb portion, the bulb portion compresses, and discharges the inside air through the pipe, and when pressing pressure on the bulb portion is released, the bulb portion expands to suck external cosmetic through the pipe. Thus, the user can use to adjust the force applied to the bulb portion to regulate the amount of the cosmetic composition discharged from the cosmetic dropper according to the need of the user.

According to a preferred embodiment of the present disclosure, the distal end portion of the pipe can be formed in a shape in which the cross-section further widens. In alternate embodiments, a diameter or a width of the pipe may remain substantially same throughout its length.

According to a preferred embodiment of the present disclosure, the pipe has a cylindrical shape portion defined at the proximal end portion of the pipe and a truncated cone portion defined at a distal end portion of the pipe, and wherein the diameter of the truncated cone portion increases towards the distal end of the pipe. The pipe has a reservoir space where the cosmetic composition is stored after suction from the cosmetic container, and truncated cone portion of the pipe has a solid region provided with at least one feed channel and a fitment groove formed therein.

Further, the at least one feed channel of the pipe opens into at least one dispensing opening on a distal end surface of the pipe. In an embodiment of the present disclosure, it is generally preferred that there be three longitudinal feed channels with respective three dispensing openings, each dispensing opening circumferentially spaced at the distal end surface of the pipe. The feed channels, each has a narrow width so that the cosmetic can be raised easily and sucked by increasing the pressure difference between the inside and the outside of the pipe. Each of the feed-channels has the same width throughout its length. In alternate embodiments, the width of the feed-channels may vary along their length.

Furthermore, the fitment groove of the pipe extends longitudinally in the solid region and defines an opening on the distal end surface of the pipe. In a preferred embodiment, the fitment groove is concentric located at the distal end of surface of the pipe and defines a central opening on the distal end face of the pipe. However, in alternate embodiments the fitment groove may not be concentric located at the distal end of surface of the pipe. According to yet another aspect of the present disclosure, the applicator member comprises a massage ball and a fitment pin extending away from the outer surface of the massage ball. The massage ball is spherical in shape, having a first radius of curvature. However, in alternate embodiments, the massage ball may be non-spherical or of any other shape known in the art. Further, the fitment pin is a cylindrical rod. However, in alternate embodiments, the fitment pin may be non-cylindrical and is of any shape known in the art.

According to preferred embodiment, a diameter of the massage ball is greater than a diameter of the fitment groove of the pipe, therefore, when the applicator member is inserted into the fitment groove of the pipe, the massage ball is retained outside the fitment groove at the distal end surface of the pipe. The massage ball is firmly and non-rotatably seated on the distal end surface of the pipe.

According to preferred embodiment, the fitment pin of the applicator member is push fit into the corresponding fitment groove of the pipe for coupling said applicator member to the pipe in a non-rotatable manner, and wherein the massage ball is retained outside the fitment groove at the distal end surface of the pipe by an interference fit between the fitment groove and the fitment pin. The distal end surface of the pipe is a ball-contacting surface which is concave to receive the massage ball of the applicator member. In other words, the distal end surface of the pipe is preferably formed with a generally concave surface conforming to the surface of the massage ball. Where the massage ball is spherical with a first radius of curvature, the distal end surface also has a spherical curvature with a second radius of curvature to conform closely with the surface of the massage ball. In the concave surface, there is a plurality of protrusions which protrude sufficiently from the concave surface of the distal end surface to provide a clearance space between an outer surface of the massage ball and the concave distal end surface of the pipe. The plurality of protrusions is circumferentially disposed at the distal end surface of the pipe. More particularly, the clearance space is provided between the outer surface of the massage ball and the concave surface of the pipe except for those areas where the plurality of protrusions is in contact with the massage ball. This resulting clearance permits the cosmetic composition to pass freely through the pipe to the outer surface of the massage ball.

The pipe may be formed to have a predetermined thickness in a circular or polygonal tube, and the material of the pipe may be a transparent glass or plastic which confirms the contents of the pipe.

It is generally preferred that there be three circumferentially disposed protrusions, each spaced alternately around the three dispensing openings of the three feed channels of the pipe.

According to the present disclosure, it is preferably chosen that the massage ball is capable of storing and retaining thermal energy, i.e. the massage ball preferably has high thermal capacity. The massage ball and the fitment pin may be formed of at least one of a metal material, a synthetic resin material, a ceramic material, a stone, and a glass material. The massage ball is made preferably of a metallic material. The massage ball may transfer a cool sensation to the user's skin. Preferably, the massage ball is designed to apply the cosmetic composition to a particularly sensitive area, such as an eye contour area.

For applying the cosmetic composition to skin, the user first applies an external force by pressing the bulb portion and releasing it, thereby forming a pressure difference between the inside and outside of the pipe for sucking a desired volume of the cosmetic composition inside the pipe. The cosmetic dropper is then removed from the container in order to use the cosmetic composition accommodated in the pipe having the massage ball assembled with it by the above-described method. Thereafter, the cosmetic composition is applied to the skin using the ball of the cosmetic dropper. At this time, the massage ball is in contact with the skin of the user so that the cosmetic application, the cooling of the skin, and massage effect can be given at the same time. Further, sufficient amount of the cosmetic may be released from the pipe by pressing the bulb portion. Thus, re-dipping or re-loading is avoided during application and the massage ball may be re-dosed continuously without a break in usage. The cosmetic passes onto the massage ball through the three openings on the concave distal end surface of the pipe.

According to an embodiment of the present disclosure, the cosmetic container and the cap may be made of a rigid material like glass, metal, hard plastic or any other material known in the art. However, in alternate embodiments, the cosmetic container and the cap may be made of a flexible material like flexible polymeric material or any other material known in the art.

The cosmetic container may include a main body that forms a storage space for cosmetic and a neck that form an opening for the insertion of cosmetic dropper of the cosmetic composition. The outer peripheral surface of the neck can have a screw thread is formed for engagement with corresponding threads of the cosmetic dropper.

A wiper may be inserted in the neck of the cosmetic container for wiping off excess cosmetic from the pipe and applicator member. In other examples, the neck of the cosmetic container may be devoid of a wiper structure. In such an example, any excess cosmetic may be drained as the cosmetic dropper is removed from the cosmetic container.

The cosmetic container may have any predetermined three-dimensional shape capable of providing storage space in which the cosmetic composition is stored.

The present disclosure is not limited to, the broadest in accordance with the basic idea disclosed herein. It should be interpreted as having a range. Skilled artisans may implement the pattern of the non-timely manner by combining, replacement of the disclosed embodiments shape, this would also do not depart from the scope of the disclosure. In addition, those skilled in the art may readily change or modifications to the disclosed embodiments, based on the present specification, such changes or modifications also belong to the scope of the present disclosure will be apparent.

Other objects, features, and advantages of the present disclosure will become clear from the following description of the preferred embodiments when the same is read in conjunction with the accompanying drawings.

BRIEF DESCRIPTION OF THE DRAWINGS

A more complete appreciation of the present disclosure and many of the attendant advantages thereof will be readily obtained as the same becomes better understood by reference to the following detailed description when considered in connection with the accompanying drawings, wherein.

Figure 1:
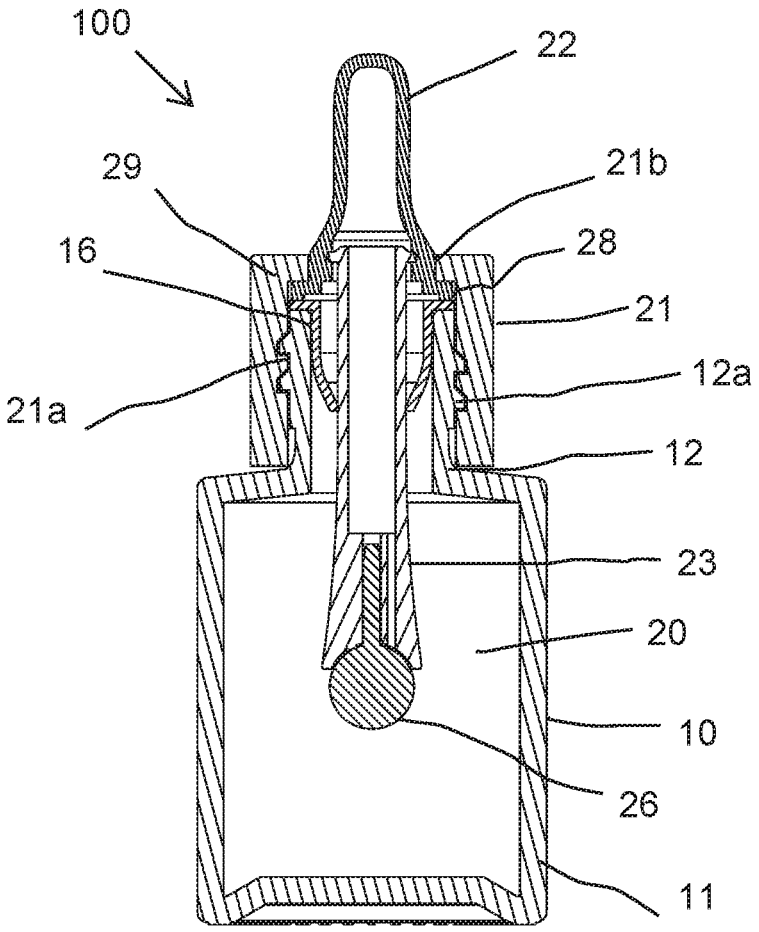
FIG. 1 shows a cross-sectional view of a cosmetic package equipped with a cosmetic dropper of present disclosure.

To facilitate understanding, identical reference numerals have been used, where possible, to designate identical elements that are common to the figures. It is to be noted, however, that the appended drawings illustrate only typical embodiments of this disclosure and are therefore not to be considered limiting of its scope, for the disclosure may admit to other equally effective embodiments.

DETAILED DESCRIPTION

Throughout this specification, the terms "comprise," "comprises," "comprising" and the like, shall consistently mean that a collection of objects is not limited to those objects specifically recited.

Figure 3:
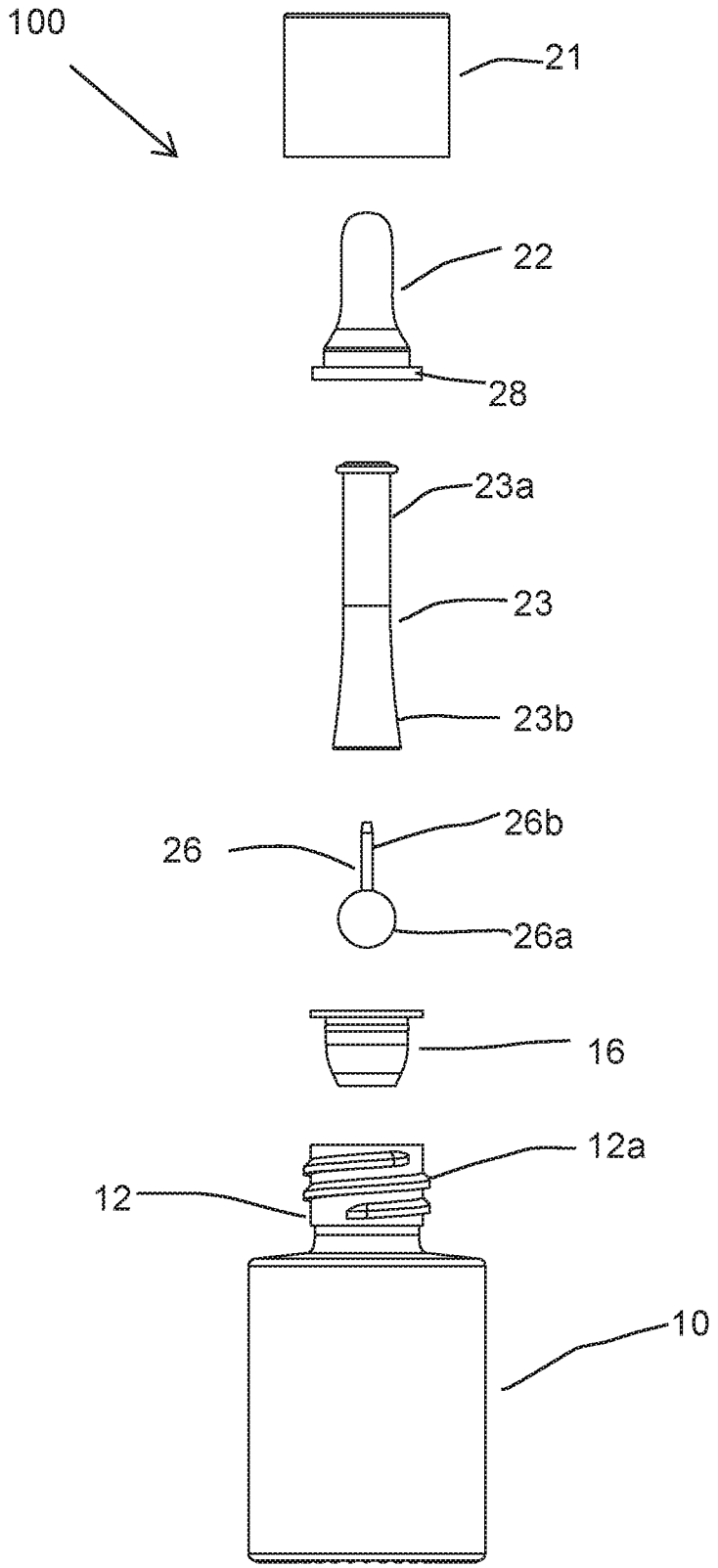
FIG. 3 shows an exploded view of the cosmetic package of FIG. 1.

FIGS. 1 and 3 show a cosmetic package 100 for storing a cosmetic composition of a liquid or viscous nature. The cosmetic package 100 includes a cosmetic dropper 20 coupled to a cosmetic container 10. The cosmetic dropper 20 comprises an applicator member 26 at its dispensing end. Applicator member 26 comprises a contact member 26*a*.

The cosmetic container 10 may have any predetermined three-dimensional shape capable of providing a storage space in which the cosmetic composition is stored, in the exemplary embodiment seen in FIG. 1, the container 10 has a cylindrical shape.

The cosmetic container 10 may include a main body that forms a storage space for the cosmetic composition and a neck 12 that form an opening for the insertion of the cosmetic dropper 20 of the cosmetic composition. The outer peripheral surface of the neck 12 can have a screw thread 12*a* that is formed for engagement with corresponding threads 21*a* of the cosmetic dropper 20.

Figure 2:
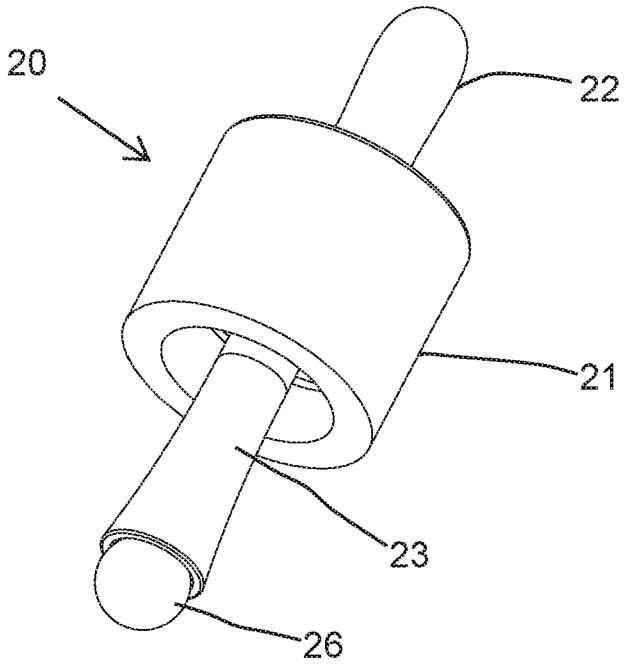
FIG. 2 shows a perspective view of the cosmetic dropper of FIG. 1.

As seen in FIGS. 1-3, the cosmetic dropper 20 has a bulb portion 22, a pipe 23, the applicator member 26, and a cap 21. The bulb portion 22 is for generating a pressure change for the suction of the cosmetic composition into the pipe 23. The pipe 23 is connected to the applicator member 26 at its distal end and to the bulb portion 22 at the proximal end for suction of the cosmetic composition into the pipe 23. The cap 21 is ring shaped and has internal threads 21*a* which are threadedly engageable on the neck 12 of the container 10. More particularly, the inner side of the cap 21 has a screw thread which are corresponding to the thread 12*a* of the neck 12.

In the example shown in FIG. 1, inserted in the neck 12 of the container 10 is a wiper 16 for wiping off excess cosmetic composition from the pipe 23. In other examples, the neck 12 of the container 10 may be devoid of any wiper structure. In such an example, any excess cosmetic may be drained as the cosmetic dropper 20 is removed from the cosmetic container 10.

In this embodiment, described with reference to the combination of the cosmetic container 10 and the cosmetic dropper 20, the dropper 20 is removably engaged to the container 10 by screwing threads 12*a* and 21*a* into engagement with one another. According to other embodiments, dropper 20 may be removably connected with container 10, for example, by a snap fit, an interference fit or other methods known in the field of the disclosure.

Referring to FIG. 1, the cap 21 includes a through central hole 21*b* through which a major portion of the bulb portion 22 projects at a proximal end portion of the cosmetic dropper 20. The bulb portion 22 includes an annular bottom sealing stopper 28 which is received beneath a top surface 29 of the cap 21, so that when the cap 21 is tightened the stopper 28 is clamped sealingly on a top rim of the container neck 12. Thus, the bulb portion 22 is arranged majorly at the upper side of the screw cap 21. A proximal end portion of the pipe 23 extends through the through central hole 21*b* of the cap 21 and is connected to the bulb portion 22. Thus, the pipe 23 is arranged majorly down side of the top surface 29 of the cap 21.

In this embodiment, the bulb portion 22 is made of a soft material or a flexible and resilient material, such as rubber that can be easily compressed and that will resiliently re-expand when a compressive force is removed.

As seen in FIGS. 1-3, the bulb portion 22 is formed to have a predetermined height on the upper side of the cap 21 and can be formed of a soft material such as rubber as described above, so that the user can easily grasp the bulb portion 22. If the user presses the bulb portion 22, the bulb portion 22 compresses, and discharges the inside air through the pipe 23, and when pressing pressure on the bulb portion 22 is released, the bulb portion 22 expands to suck external cosmetic composition through the pipe 23. Thus, the user can adjust the force applied to the bulb portion 22 to regulate the amount of cosmetic composition discharged from the cosmetic dropper 20 according to the need of the user.

Figure 5:
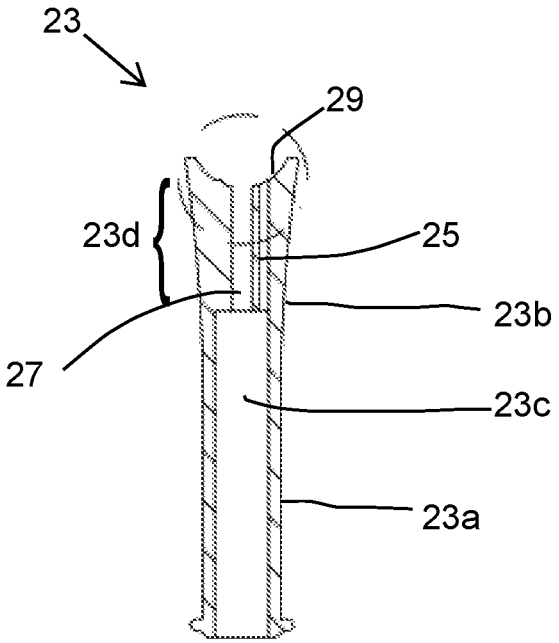
FIG. 5 shows a cross-sectional view of the pipe of FIG. 4.
Figure 4:
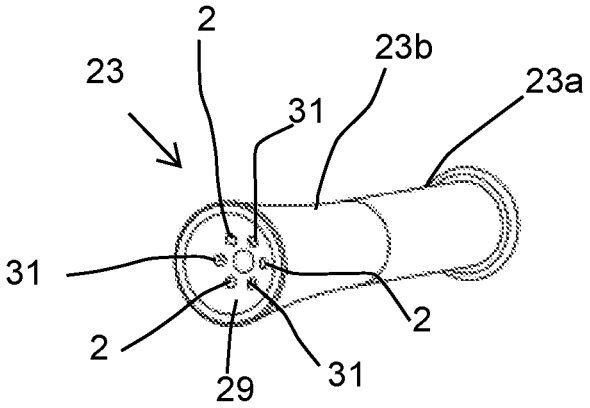
FIG. 4 shows a perspective view of a pipe of the cosmetic dropper of FIG. 2.

In this embodiment example, as shown in FIGS. 3-5, the distal end of the pipe 23 can be formed in a shape in which the cross-section further widens. In alternate embodiments, a diameter or a width of the pipe 23 may remain substantially same throughout its length. As seen specifically in FIG. 3, the pipe 23 has a cylindrical shape portion 23*a* defined at the proximal end portion of the pipe 23 and a truncated cone portion 23*b* defined at a distal end portion of the pipe 23, and wherein a diameter of the truncated cone portion 23*b* increases towards the distal end of the pipe 23. The pipe 23 has a reservoir space 23*c*, see FIG. 5, where the cosmetic composition is stored after suction from the cosmetic container 10, and the truncated cone portion 23*b* of the pipe 23 has a solid region 23*d* provided with at least one feed channel 25 and a fitment groove 27 formed therein.

As shown in FIGS. 4-5, the at least one feed channel 25 of the pipe 23 opens into at least one dispensing opening 2 on a distal end surface 29 of the pipe 23. In the exemplary embodiment, it is generally preferred that there be three longitudinal feed channels 25 with respective three dispensing openings 2, the dispensing openings 2 are circumferentially spaced at the distal end surface 29 of the pipe 23. The feed channels 25 has a narrow width so that the cosmetic can be raised easily and sucked by increasing the pressure difference between the inside and the outside of the pipe 23. It is to be noted that the feed-channels 25 illustrated in FIG. 5 has the same width throughout its length. In alternate embodiments, the width of the feed-channels 25 may vary along their length.

Furthermore, the fitment groove 27 extends longitudinally in the solid region defined in the truncated cone portion 23*b* of the pipe 23 and defines an opening 3 on the distal end surface 29 of the pipe 23. In the exemplary embodiment, the fitment groove 27 is concentric and defines a central opening 3 on the distal end face 29 of the pipe 23. In alternate embodiments, the fitment groove 27 and corresponding opening 3 may not be centrically located in the pipe 23.

Figure 7:
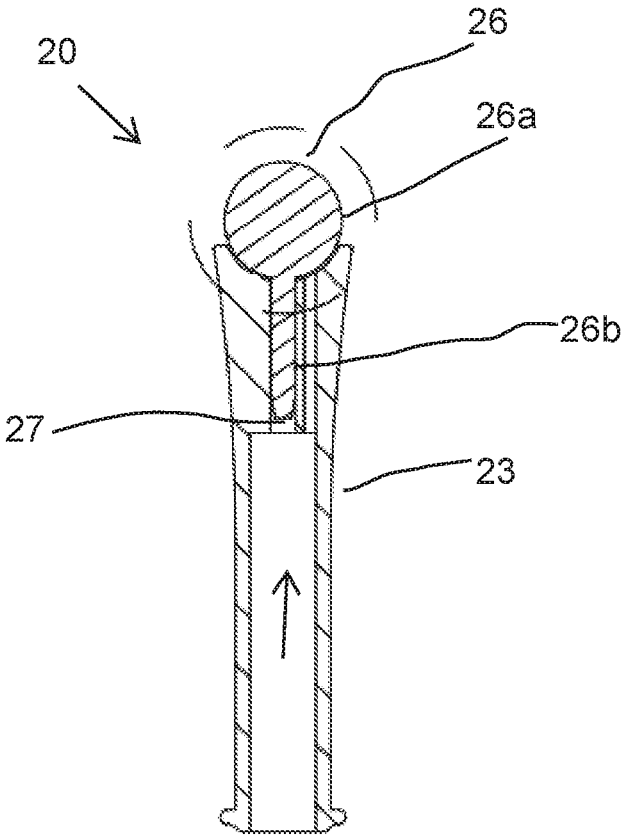
FIG. 7 shows a cross-sectional view of the cosmetic dropper of FIG. 2, shown without a cap and a bulb portion.
Figure 8:
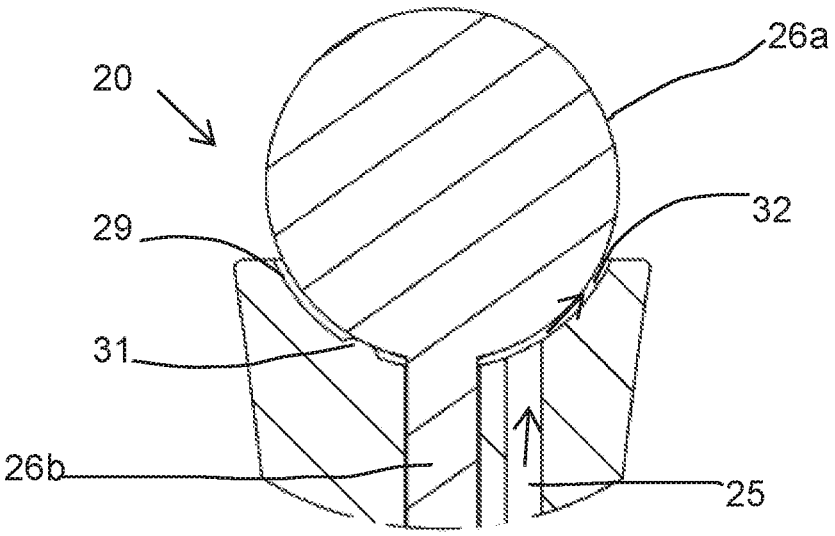
FIG. 8 shows a partial enlarged cross-sectional view of the cosmetic dropper of FIG. 7.

Further, referring to FIGS. 5 and 7-8, according to one embodiment the contact member 26*a* of the applicator member 26 comprises a massage ball 26*a*. Applicator member 26 also comprises a fitment pin 26*b* extending away from the outer surface of the massage ball 26*a*. The massage ball 26*a* is spherical in shape. However, in alternate embodiments, the massage ball 26*a* may be non-spherical or of any other shape known in the art. According to an embodiment of the present disclosure, the fitment pin 26*b* is a cylindrical rod. However, in alternate embodiments, the fitment pin 26*b* may be non-cylindrical and is of any shape known in the art.

A diameter of the massage ball 26*a* is greater than a diameter of the fitment groove 27 of the pipe 23 therefore when the applicator member 26 is inserted into the fitment groove 27 of the pipe 23, the massage ball 26*a* retains outside the fitment groove 27 at the distal end face 29 of the pipe 23. The massage ball 26*a* as shown more particularly in FIGS. 7 and 8 is firmly and non-rotatably seated on the distal end surface 29 of the pipe 23.

Figure 6:
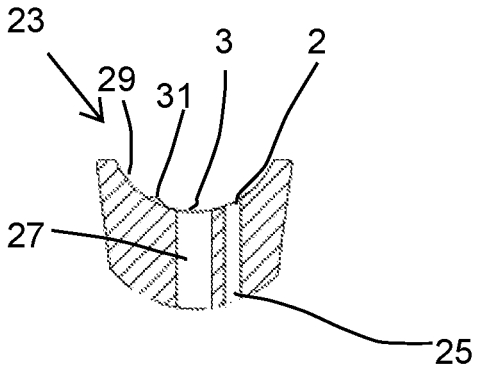
FIG. 6 shows a partial enlarged cross-sectional view of the pipe of FIG. 5.

Preferably, the fitment pin 26*b* of the applicator member 26 is push fit into the corresponding fitment groove 27 of the pipe 23 for coupling said applicator member 26 to the pipe 23 in a non-rotatable manner, and wherein the massage ball 26*a* is retained outside the fitment groove 27 at the distal end surface 29 of the pipe 23. In alternate embodiments, the fitment pin 26*b* is secured within the fitment groove 27 by other securing means known in the field of the disclosure. As seen in FIGS. 4-6, the distal end surface 29 of the pipe 23 is a ball-contacting surface 29 which is concave to receive the massage ball 26*a* of the applicator member 26. In other words, the distal end surface 29 is preferably formed with a generally concave surface 29 that is partially spherical so that it is conforming to the surface of the massage ball 26*a*. According to one embodiment, the concave surface 29 is concentric with the proximal surface of massage ball 26*a*. In the concave surface 29, there are a plurality of protrusions 31 which protrude sufficiently from the concave surface 29 of the distal end surface 29 to provide a clearance space 32 between an outer surface of the massage ball 26*a* and the concave distal end surface 29 of the pipe 23. The plurality of protrusions 31 is circumferentially disposed at the distal end surface 29 of the pipe 23. Referring to FIG. 8, the clearance space 32 is provided between the outer surface of the massage ball 26*a* and the concave surface 29 of the pipe 23 except for those areas where the plurality of protrusions 31 is in contact with the massage ball 26*a*. This resulting clearance space 32 permits the cosmetic composition to pass freely through the pipe 23 to the outer surface of the massage ball 26*a*.

It is generally preferred that there be three circumferentially disposed protrusions 31, each spaced alternately around the three dispensing openings 2 of the three feed channels of the pipe 23, as illustrated in FIG. 4.

According to the present disclosure, it is preferably chosen that the massage ball 26*a* is capable of storing and retaining thermal energy, i.e. the massage ball 26*a* preferably has high thermal capacity. The massage ball 26*a* and the fitment pin 26*b* may be formed of at least one of a metal material, a synthetic resin material, a ceramic material, a stone, and a glass material. In this case, the massage ball 26*a* is made preferably of a metallic material. The metal may be stainless steel, aluminum, titanium, brass, silver, gold, steel, carbon, carbon fiber, nickel, tin, copper, brass, and alloys thereof. The massage ball 26*a* may transfer a cool sensation to the user's skin. Preferably, the massage ball 26*a* is designed to apply the cosmetic composition to a particularly sensitive area, such as an eye contour area.

For applying the cosmetic composition to skin, the user first applies an external force by pressing the bulb portion 22 and releasing the bulb, which resiliently expands to form a pressure difference between the inside and outside of the pipe 23 for sucking a desired volume of the cosmetic composition inside the pipe 23. The cosmetic dropper 20 is then removed from the container 10 in order to use the cosmetic composition accommodated in the pipe 23 having the massage ball 26*a* assembled with it by the above-described method. Thereafter, the cosmetic composition is applied to the skin using the massage ball 26*a* of the cosmetic dropper 20. At this time, the massage ball 26*a* is in contact with the skin of the user so that the cosmetic application, the cooling of the skin, and massage effect can be given at the same time. Further, sufficient amount of the cosmetic composition may be released from the pipe 23 by pressing the bulb portion 22. Thus, re-dipping or re-loading is avoided during application and the massage ball 26*a* may be re-dosed continuously without a break in usage. FIG. 8 illustrates by way of arrows the path followed by the cosmetic composition as it is drawn through the pipe 23. The cosmetic composition passes onto the massage ball 26*a* through the openings 2 on the concave distal end surface of the pipe 23.

The pipe 23 of the present disclosure may be formed to have a predetermined thickness circular or polygonal tube, and the material of the pipe 23 may be transparent glass or plastic can confirm the contents of the pipe 23.

According to an embodiment, the cosmetic container 10 and the cap 21 may be made of a rigid material like glass, metal, hard plastic or any other material known in the art. However, in alternate embodiments, the cosmetic container 10 and the cap 21 may be made of a flexible material like flexible polymeric material or any other material known in the art.

The present disclosure is not limited to these particular embodiments but encompasses the broadest aspects of the basic ideas disclosed herein. The present disclosure should be interpreted as showing a range of exemplary embodiments. Should skilled artisans implement designs along the lines of the ideas disclosed, for example, by combining elements, replacing elements with other structures, or modifying shapes of elements of the illustrative embodiments, this would not depart from the scope of the disclosure. In addition, should those skilled in the art change or make modifications to the disclosed embodiments, based on the present specification, such changes or modifications also belong to the scope of the present disclosure.

Although, the present disclosure has been described with reference to exemplary embodiments, it is not limited thereto. Those skilled in the art will appreciate that numerous changes and modifications may be made to the preferred embodiments of the present disclosure and that such changes and modifications may be made without departing from the true spirit of the present disclosure. It is therefore intended that the appended claims be construed to cover all such equivalent variations as fall within the true spirit and scope of the present disclosure.

What is claimed is:

1. An applicator assembly for applying a substance to a keratinous surface comprising:

a pipe, the pipe including a proximal end, a distal end, and an internal reservoir space, wherein the distal end comprises a fitment groove and one or more feed channels in fluid communication with the reservoir space, wherein the feed channels terminate in one of more respective dispensing openings;

an applicator member, the applicator member including a contact member and a fitment pin, wherein the fitment pin extends from the contact member in a proximal direction, and wherein the fitment pin is received in the fitment groove to fix the applicator member to the distal end of the pipe; and a bulb portion connected with the proximal end of the pipe, in fluid communication with the internal reservoir, and adapted to pneumatically displace the substance into and out of the reservoir space via the feed channels.

2. The applicator assembly of claim 1, wherein the applicator member comprises a massage ball.

3. The applicator assembly of claim 2, wherein the massage ball is spherical.

4. The applicator member of claim 1, wherein the applicator member is formed from a heat transfer material.

5. The applicator assembly of claim 4, wherein the applicator member is formed from one or more of a metal material, a synthetic resin material, a ceramic material, a stone, and a glass material.

6. The assembly of claim 5, wherein the metal material is selected from stainless steel, aluminum, titanium, brass, silver, gold, steel, carbon, carbon fiber, nickel, tin, copper, brass, and alloys thereof.

7. The applicator assembly of claim 1, wherein the fitment pin is a cylindrical rod and wherein the applicator member is fixed to the pipe by an interference fit between the fitment pin and the fitment groove.

8. The applicator assembly of claim 1, wherein the distal end of the pipe comprises a concave distal end surface, and wherein the fitment groove and the dispensing openings terminate on the concave distal end surface.

9. The applicator assembly of claim 8, wherein the distal end surface has a first spherical curvature, wherein a proximal surface of the applicator member has a second spherical curvature and is concentric with the distal end surface, wherein the proximal surface of the applicator member is separated from the distal end surface by a clearance space, and wherein the dispensing openings are in fluid communication with the clearance space.

10. The applicator assembly of claim 9, wherein the distal end surface comprises one or more surface protrusions, and wherein the surface protrusions contact the proximal surface of the applicator member to define the clearance space.

11. The applicator assembly of claim 1, wherein the pipe comprises a proximal cylindrical shaped portion connected with the bulb portion and a distal truncated cone portion and wherein the distal end surface is at a distal end of the truncated cone portion.

12. The applicator assembly of claim 1, further comprising a container adapted to hold the substance, the container comprising a neck and a wiper disposed within the neck, wherein, in an inserted configuration, the pipe extends through the wiper and into the container and wherein, when the pipe is pulled in a proximal direction through the wiper, the wiper wipes an outer surface of the pipe.

13. The applicator assembly of claim 12, wherein the bulb portion comprises a resiliently expandable material, wherein, in the inserted configuration, the applicator member and distal end surface are immersed in the substance, wherein a resilient expansion of the bulb pneumatically draws the substance into the reservoir space.

14. The applicator assembly of claim 13, wherein compression of the bulb portion pneumatically displaces the substance from the reservoir space onto the applicator member via the feed channels.

* * * * *